United States Patent [19]

Kränzle et al.

[11] Patent Number: 4,989,786

[45] Date of Patent: Feb. 5, 1991

[54] ROTATABLE NOZZLE IN PARTICULAR FOR HIGH PRESSURE CLEANING APPARATUSES

[76] Inventors: Josef Kränzle, Rudolf-Diesel-Str. 20, D-7918 Illertissen; Anton Jäger, Eschachstr. 4, D-7913 Senden, both of Fed. Rep. of Germany

[21] Appl. No.: 435,858

[22] Filed: Nov. 14, 1989

[30] Foreign Application Priority Data

Jan. 27, 1989 [DE] Fed. Rep. of Germany ..... 3902478

[51] Int. Cl.[5] ..... B05B 3/02; B08B 3/02

[52] U.S. Cl. ..... 239/240; 239/263

[58] Field of Search ..... 239/237, 240, 263

[56] References Cited

U.S. PATENT DOCUMENTS

| | | | |
|---|---|---|---|
| 3,447,749 | 6/1969 | Hruby, Jr. | 239/263 |
| 4,073,438 | 2/1978 | Meyer | 239/237 |
| 4,272,025 | 6/1981 | Mazzotti | 239/240 |
| 4,708,290 | 11/1987 | Osmond | 239/240 |
| 4,747,544 | 5/1988 | Kranzle | 239/251 |
| 4,802,628 | 2/1989 | Dautel et al. | 239/240 |

FOREIGN PATENT DOCUMENTS

| | | |
|---|---|---|
| 3419964 | 12/1985 | Fed. Rep. of Germany . |
| 8801793 | 2/1988 | Fed. Rep. of Germany . |

*Primary Examiner*—Andres Kashnikow
*Assistant Examiner*—Karen B. Merritt
*Attorney, Agent, or Firm*—Lowe, Price, LeBlanc, Becker & Shur

[57] ABSTRACT

A rotatable nozzle comprising a housing having arranged therein a rotor rotatable about a longitudinal axis which is inclined in respect of a central axis of the housing. The rotor is peripherally provided with a blade wheel the blades of which being positioned in the flow path of an inlet beam of pressurized liquid for rotating the rotor and orbiting it around the central axis.

14 Claims, 4 Drawing Sheets

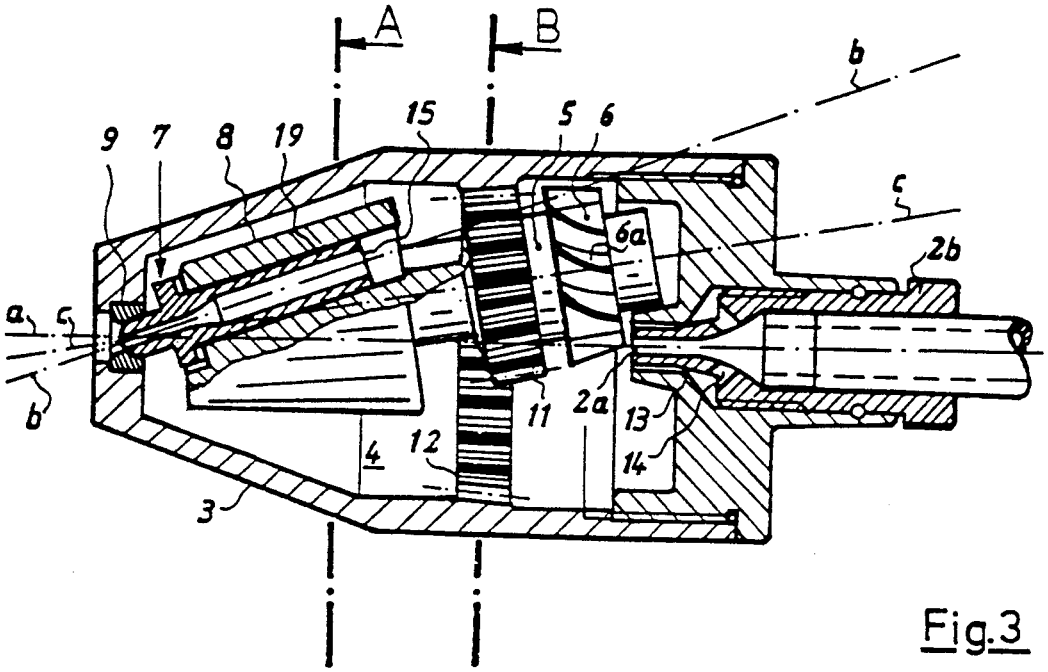
Fig.3
Fig.4c
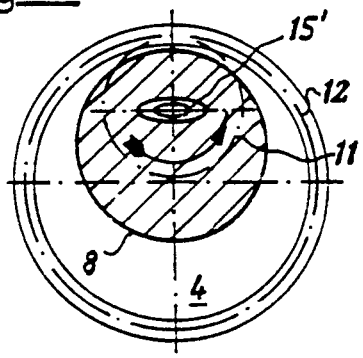
Fig.4d
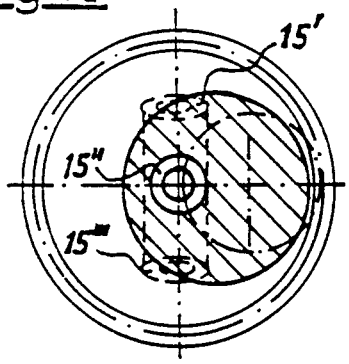
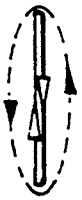
Fig.4a
Fig.4f
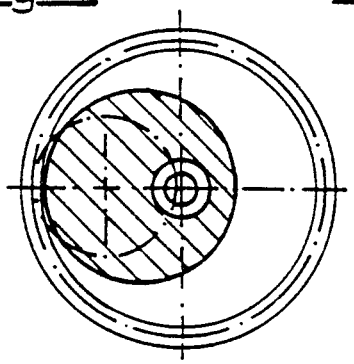
Fig.4e
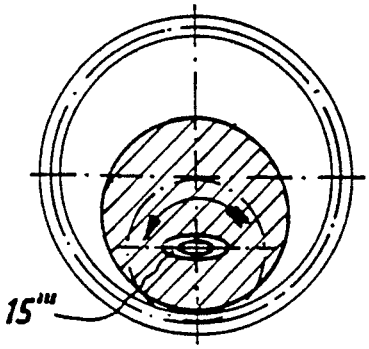
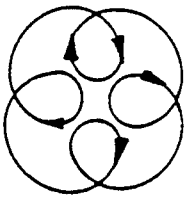
Fig.4b

ROTATABLE NOZZLE IN PARTICULAR FOR HIGH PRESSURE CLEANING APPARATUSES

FIELD OF THE INVENTION

The invention relates to a rotatable nozzle in particular for high pressure cleaning apparatuses for generating a sharp beam of liquid which when impinging onto a surface to be cleaned performs circular movements.

TECHNICAL BACKGROUND

The European Patent Application EP-A-0 252 261 discloses a rotatable nozzle for high pressure cleaning apparatuses. With this nozzle cleaning liquid is supplied through a central inlet opening of a housing and is passed outward through channels onto a blade wheel of a turbine body causing a rotation of a rotor radially and axially supported on a central bearing stud. Having passed the blades of the turbine body the pressurized cleaning liquid enters a collecting space and flows through inlet openings into a nozzle and subsequently out of the rotatable nozzle in a conical shape. The nozzle supports on a pin which in turn supports with its front end in an open pan bearing, with the rear end of the pin-type nozzle body supported in an excentric driving pan of the rotor driven by the blade wheel.

West German Patent Application DE-A-34 19 964 discloses a similar design of a rotatable nozzle using a diverting body for directing entering cleaning liquid onto turbine blades, the cleaning liquid exiting in a conical shape, a nozzle arranged inclined to a central axis in a separate nozzle body.

The West German Utility Model DE-U-88 01 793 discloses a further rotatable nozzle using a guiding ring for diverting the entering cleaning liquid onto a rotor ring formed like a francis turbine. The rotating body centrally supported on an axis fixed at a support plate provided with passages drives a nozzle body via an excenter in order to achieve an oscillating path of movement of the nozzle body, in turn, of the exiting beam. In order to avoid excessive rotational speed the rotating ring is provided with a separating wall forming a retarding gap for limiting the rotational speed of the turbine at high liquid pressures.

The USA Patent Specification No. 4,747,544 discloses a spray device comprising a central support and supply element bearing a rotational body for rotation about a central axis. At least one nozzle element is attached at the front surface of a rotational body at the outlet side of a spray device. The axis of the nozzle element is offset both to the central axis and to the direction of rotation of the rotational body. The rotational body is closely surrounded by a jacket.

All these known rotatable nozzles have the disadvantage that the entering cleaning liquid is first passed outward through separate diverting bodies onto the blade wheel of the centrally supported rotor. Furthermore, these known designs need a centrally mounted bearing axle in order to axially and radially support the rotating blade wheel. Moreover, the rotor having the blade wheel mounted thereon and the nozzle body are inherently formed as two parts in view of the rotational axes inclined to each other each part being necessarily separately supported. This results in a very complex design in view of the high number of individual parts and the inherent separate supports. Furthermore, due to the series arrangement of inlet opening, diverting body, turbine wheel, etc., the known rotatable nozzles have a large longitudinal extension. In particular, the bearing between the nozzle body and the excenter is subject to considerable wear in view of the super-imposed rotation and linear swing limitation.

SUMMARY OF THE INVENTION

It is an object of the instant invention to provide a rotatable nozzle of considerably simplified design.

It is a further object of the instant invention to provide a rotatable nozzle having a rather compact design.

It is a still further object of the instant invention to provide a rotatable nozzle with improved and safer operation than known devices.

These and other objects of the invention are solved by a rotatable nozzle comprising:

A housing having provided at a rear end thereof a central inlet opening extending along a central axis of said housing for supply of pressurized liquid and enclosing an essentially cylindrical collecting space; a rotor rotatably supported in said housing for rotation about a longitudinal axis inclined in respect of said central axis, a blade wheel means peripherally mounted on a rear portion of said rotor having blades arranged in a path of an inlet beam of said pressurized liquid entering said collecting space through said central inlet opening, causing an orbiting movement of said rotor about said central axis; and a nozzle means arranged at a front end of said rotor and having a front end formed as a part of a bearing provided at an outlet side of said housing.

In view of the inclination of the rotational axis of the blade wheel and that of the rotor in respect of the central axis the blade wheel will orbit the central inlet opening or the inlet nozzle thereof; a portion of the blade wheel, i.e. at least one blade will be directly loaded by the pressurized liquid at any time. Thus, no complex diverting body for the diverting of the pressurized liquid in outward direction is necessary; rather the cleaning liquid may centrally enter the rotatable nozzle and load the blade wheel without diversion. Omitting the diverting body results both in a reduction of cost and overall length of the rotatable nozzle. Furthermore, the rotor supporting the blade wheel and including the nozzle may be formed unitary in view of a common rotational axis. In addition of the reduction of the production and assembly expenditures a further simplification is achieved by omitting roller bearings between the rotor and the nozzle as necessary with known devices.

In a preferred embodiment the nozzle or a nozzle tube thereof, respectively, may be rotatably supported in a nozzle body such that the outlet opening of the nozzle performs a swivelling movement only in its front pan bearing avoiding an additional rotational movement subject to intensive wear in the pan bearing. Furthermore, the overall length of the rotatable nozzle is reduced since the inlet opening to the nozzle is arranged behind the blade wheel. With known rotatable nozzles the series arrangement in flow direction had to be strictly followed from the diverting body, the blade wheel, the inlet opening to the nozzle.

Preferably, the nozzle body/rotor unit is supported in the rear region at the inner peripheral surface of the housing by means of a support bearing avoiding the shaping of further bearing seats or studs. In total the rotatable nozzle according to the invention uses two simple bearings only whilst with known devices separate bearings, radial and axial bearings as well as support plates for the bearings had to be provided. Furthermore, this rear side bearing of the rotor is much simpler as compared with the prior art since it performs a rotational movement only without any swivel or linear swing movement; thus, this bearing is subject to wear to a considerable less extent.

It is of further advantage that the blades of the blade wheel pass close to the exit opening of the central inlet nozzle resulting in a very short overall length of the rotatable nozzle.

A specific advantage of the rotatable nozzle according to the invention is the arrangement of a gear on the rotor meshing with an inner gear ring fixedly secured to the inner periphery of the housing. This results in a high down-transmission ratio for the rotation of the nozzle, specifically with a gear ring having a multiple number of teeths in respect of the gear. This results in an improved cleaning effect, specifically with a high pressure since the cleaning beam acts onto the surface to be cleaned for a longer time. With known devices so-called speed limiters based on the principle of an eddy motion brake had been used which, however, are effective in a very limited range of speed only. In contrast, with the preferred embodiment of the invention the rotatable nozzle may be reliably used both with low and very high pressures still maintaining a preselected transmission ratio.

It is of further advantage that with the rotatable nozzle of the invention the nozzle may be inclined in respect of the rotational axis of the rotor or the nozzle body, respectively, resulting in some type of oscillation of the cleaning beam. The freely selectable inclination of the nozzle in respect of the rotational axis of the rotor in connection with the selection of the down-transmission ratio enables various beam images of the cleaning beam including a modification from the conical surface type of image with coinciding axes. For example, with twice the angle between the exit axis of the nozzle and the center axis as compared with the angle of the rotational axis a nearly linear type beam image may be achieved. Thus, the rotational and orbiting movement is converted into a linear movement of the cleaning beam. This may be of particular advantage when cleaning bar-type machine elements or for a line-type cleaning exemplary used in car washing systems. Starting from this linear beam image by changing the angle of inclination of the nozzle and/or the transmission ratio any desired type of ellipse up to a circular beam image may be achieved. With the exit axis of the nozzle located between this rotational axis of the rotor and the central axis a circular beam image may be achieved superimposed by a further circular movement. Such an rosette-type beam image is specifically adapted for cleaning car wheel rims since a circular ring surface is cleaned intensively whilst leaving the central region of the hub almost unaffected.

The preferred embodiments of the rotatable nozzle of the invention as outlined above may be produced much simpler by combining the described elements to a unitary part.

Since the beam leaving the inlet nozzle is immediately directed to the blade wheel, it is possible to adjust the rotational speed by varying the amount of cleaning liquid supplied to the blade wheel. This may be accomplished by more or less closing or opening bypass passages by axial adjustment, for example screwing-in or screwing-out of a control element such as a needle. Such rotational speed control may be accomplished with known devices only by very complex measures, for example, by adjusting the pressure of the supplied cleaning liquid.

BRIEF DESCRIPTION OF THE DRAWINGS

Several embodiments of the invention are explained hereinafter in more detail by referring to the drawings.

FIG. 3 is a view similar to that of FIG. 1 of a rotatable nozzle of the third embodiment of the invention using a nozzle having an additional inclination;

FIG. 4 (*c–f*) are cross-sectional views of the rotatable nozzle of FIG. 3 in four different positions;

FIG. 4*a* and *b* are schematic views of possible beam-images performed by the liquid beam on a surface to be cleaned;

BEST MODE TO CARRY OUT THE INVENTION

Figure 1:
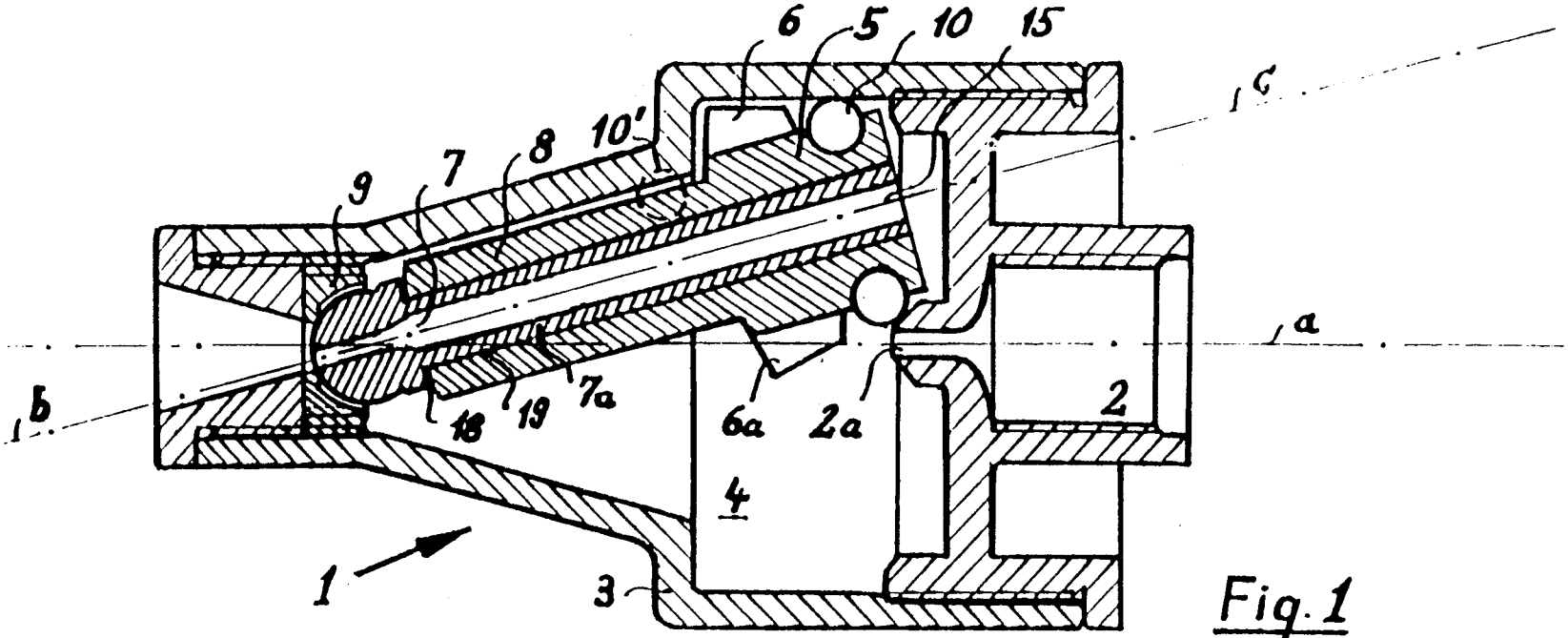
FIG. 1 is a longitudinal sectional view of a rotatable nozzle of simple design.

FIG. 1 illustrates a first embodiment of a rotatable nozzle 1 in simple design. The rotatable nozzle 1 is provided with a central inlet opening 2 ending in the form of an inlet nozzle 2*a* in a collecting space 4 formed within a housing 3. A rotor 5 rotates about a rotating axis c inclined in respect of the central axis a of the rotatable nozzle 1. A blade wheel 6 surrounds the rotor 5 and has a diameter such that at least one of the blades 6*a* is hit by the beam entering the space 4 through the inlet nozzle 2*a*. A nozzle 7 including a nozzle tube 7*a* is provided in the front region of the rotatable nozzle 1 in a nozzle body 8 supported by an axial bearing flange 18 and a radial bearing 19 and having an outlet axis b. With the instant embodiment the outlet axis b of the nozzle 7 and the rotation axis c of the rotor 5 coincide with each other. The nozzle body 8 and the nozzle 7, respectively, inserted therein is mounted at its front end in a cup bearing 9. With this embodiment the nozzle body 8 and the rotor 5 are formed unitary and are supported in a further bearing 10 mounted at the inner peripheral of the housing 3. Since the bearing reaction force acting onto the bearing 10 as a result of the beam impinging onto the blades 6*a* is essentially directed outward a support onto the inner surface of the housing 3 is sufficient. Therefore, the supporting bearing 10 may be designed as a stationary ring bearing mounted in the housing 3 as it is indicated with the reference No. 10' and shown in FIG. 5.

Cleaning liquid entering the collecting space 4 through the inlet nozzle 2*a* impinges onto the blade wheel 6 resulting in a rotation of the rotor 5 and the nozzle body 8 about the rotating axis c the blade wheel 6 orbiting about the central axis a and, therefore, the central inlet nozzle 2*a* such that the blade wheel 6 is continuously loaded. Leaving the blade wheel 6 the cleaning liquid passes through a collecting space 4 via a rear inlet opening 15 into the nozzle 7 and exits as a cleaning beam having the shape of a conical envelope. Upon stopping pressure supply the rotor 5 remains in its position supported by the bearing 10 which has an inner support adjacent to the inlet nozzle 2*a* whilst its outer support is the inner peripheral surface of the collecting space 4. For such a relatively loose bearing assembly it may be sufficient to replace the ball bearing 10 by just a rearward extending projection of the rotor 5 bearing against a support surface 16 (see FIG. 2) as it is shown in FIGS. 2, 3, 5, and 6.

Figure 2:
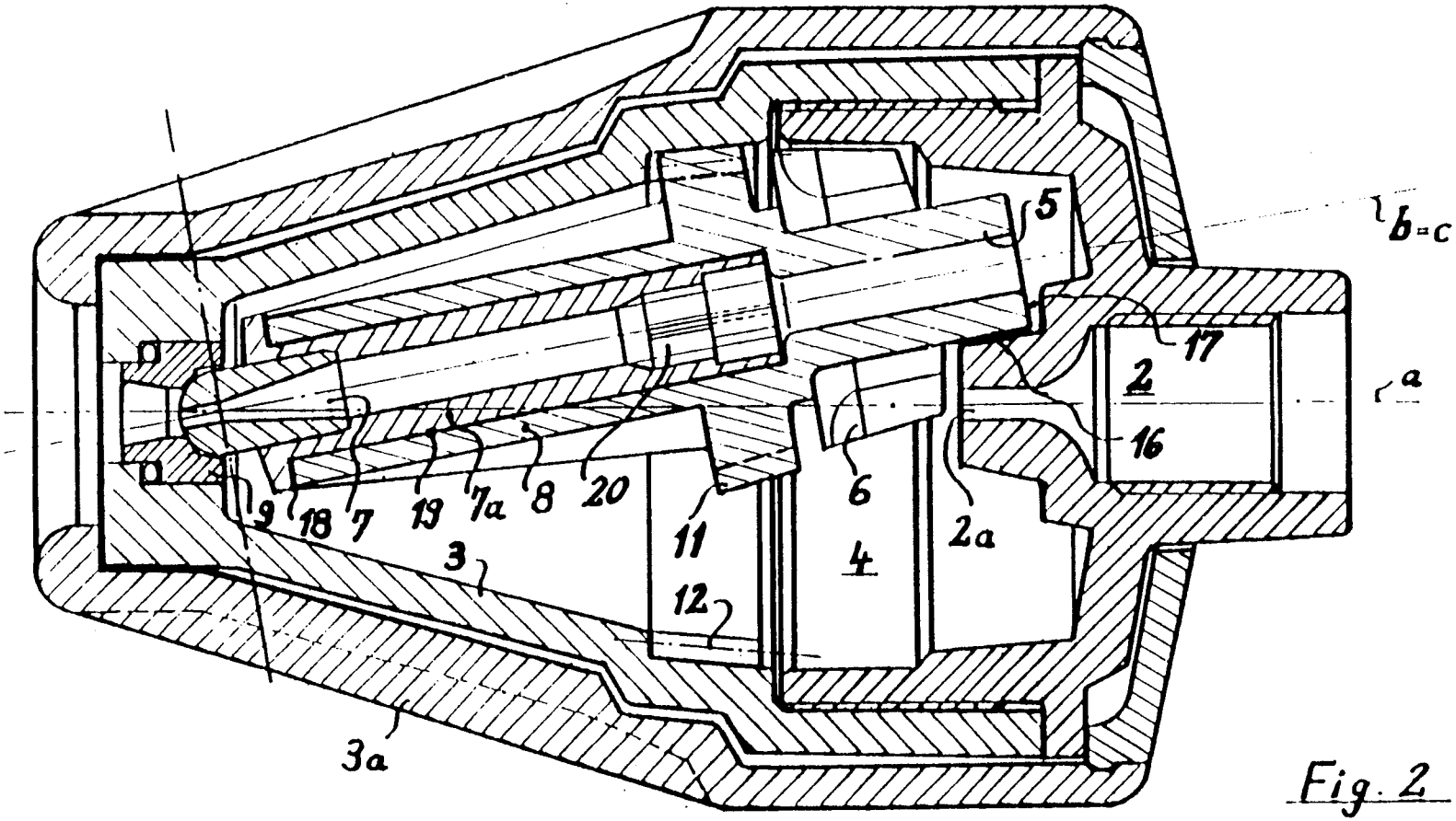
FIG. 2 is a view similar to that of FIG. 1 of a rotatable nozzle using down-transmission for the rotation according to a second embodiment of the invention.

FIG. 2 illustrates an improved design of rotor nozzle 1 where similar reference Nos. are used as in FIG. 1. Different from FIG. 1 the housing 3 is surrounded by an additional protecting sleeve 3*a*. Furthermore, the housing 3 is provided with an interior peripheral gear ring 12 meshing with a gear 11 of the nozzle body 8/rotor 5 unit. The engagement of the gear 11 in the gear ring 12 serves as an outward support of the rotor 5 such that the bearing 10 (see FIG. 1) may be omitted. Due to the rotation of the rotor 5 caused by the blade wheel 6 the gear 11 rolls along the inner gear ring 12 resulting in a uniform rotational or swinging movement of the cleaning beam exiting the nozzle 7. Selecting the number of gear teeths enables a free setting of the rotational speed of the rotating cleaning beam according to specific use.

Furthermore, FIG. 2 shows the support of the nozzle body 8 at the axial bearing flange 18 transmitting axial forces caused by loading the blade wheel 6 via the nozzle tube 7*a* onto the swing bearing 9. In contrast to the embodiment of FIG. 1, in the instant case the nozzle tube 7*a* is provided with a separate nozzle head 7 formed, for example, of ceramic material in order to reduce wear, whilst the nozzle tube 7*a* forming the inner stud of the radial bearing 19 preferably is formed of metal. The nozzle body 8 supported by this radial bearing 19 is preferably unitary with the gear 11, the rotor 5 and the blade wheel 6 as a die-casting part. The radial bearing 19 has a relatively large loose such that for assembly and maintenance purposes it may be easily separated by axial removal of the nozzle tube 7*a* out of the nozzle body 8.

Furthermore, the rotor 5 of this embodiment is provided with a well-known uniformer 20 and has a small axial loose 17 at its rear end face preventing the removal of the rotor 5 out of the swing bearing 9 when the rotor nozzle 1 is not in operation.

FIG. 3 shows the third embodiment which is similar to that of FIG. 2 with the exception that the exiting axis b of the nozzle 7 does no more coincide with the central rotating axis c of the rotor 5. Rather this axis b is further inclined outward. In addition to the rotational movement this results in an oscillating linear movement of the cleaning beam. Again the nozzle 7 is supported in the nozzle body 8 by the radial bearing 19 and has an inlet opening 15 in the instant case provided closer to the front end of the nozzle body 8. As an improvement in respect of the embodiments of FIGS. 1 and 2 the central inlet opening 2 is provided with a nozzle needle 2*b* which may be screwed-in more or less into the inlet opening 2 according to the indicated arrow. Turning the nozzle needle 2*b* in a direction to move it to the right in FIG. 3 results in an annular gap of conical shape 13 such that cleaning liquid may enter via bypass bores 14 into the collecting space 4 without loading the blade wheel 6. This throughput control of the quantity of cleaning liquid enables a desired selection of the rotational speed of the rotor 5.

FIG. 4*c*–4*f* schematically illustrate the rotation of the rotor 5 and the nozzle body 8, respectively, in clockwise direction the nozzle body 8 being cut according to the sectional plane A in FIG. 3, however, with the gear 11 and the gear ring 12 being shown as well as cut along the sectional plane B. The position shown in FIG. 4(*c*) corresponds to the position of the nozzle body 8 according to FIG. 3. In view of the downward inclination of the nozzle body 8 the inlet opening 15 is seen as an ellipse. FIG. 4(*d*) shows the nozzle body 8 after a rotation by 90° with the inlet opening 15 in its central position designated with 15″. It should be mentioned that the reference No. 15′ indicates the position of the inlet opening 15 according to FIG. 4(*c*) and FIG. 3. FIG. 4(*e*) illustrates the situation after a rotation by 180° where the position of the inlet opening 15 is designated with the reference No. 15‴. FIG. 4(*f*) corresponds to a rotation by 270° with the inlet opening 15 again in the central position according to FIG. 4(*d*). In FIG. 4(*d*) the movement of the inlet opening 15 is indicated in dashed lines. As may be gathered specifically from FIG. 4 (*d*) the inlet opening 15 moves on a vertical path during the transition from 15′ to 15″ and 15‴ and back to the position shown in FIG. 4(*c*). This linear movement derived from a uniform rotational movement may be of particular advantage for certain cleaning purposes and is illustrated in FIG. 4*a*.

As may be gathered from this embodiment having a twice as large inclination angle of the nozzle 7 in respect of the inclination angle of the rotational axis c by increasing the inclination angle of the axis b an elliptic beam image (see dashed lines in FIG. 4*a*) may be produced instead of the linear beam image shown by the solid lines of FIG. 4(*a*). Decreasing the inclination angle of the exit axis b in respect of the arrangement according to FIG. 3 results in an elliptic beam image as well, however, with the essential omission of the central region. For further varying the beam image the exit axis b may be arranged between the rotational axis c and the central axis a resulting in a circular beam image (see FIG. 4*b*) with an inner rotation within the circus similar to a rolling movement along an involute.

The number of inner rotation during one rotation is determined by the down-transmission ratio of the gear teeth number of the gear ring 12 in respect to that of the gear 11 and may be selected in wide limits. According to FIG. 4*b* a down-transmission ratio of 4:1 would result in a flower-like beam image having four "leaves". Such a shape may be particular adapted for cleaning of car wheels.

Accordingly, the rotatable nozzle according to the invention permits by adjustment of the nozzle body or exchange of the nozzles having different exit axes to produce various beam images mostly adapted for a specific cleaning purpose.

Figure 5:
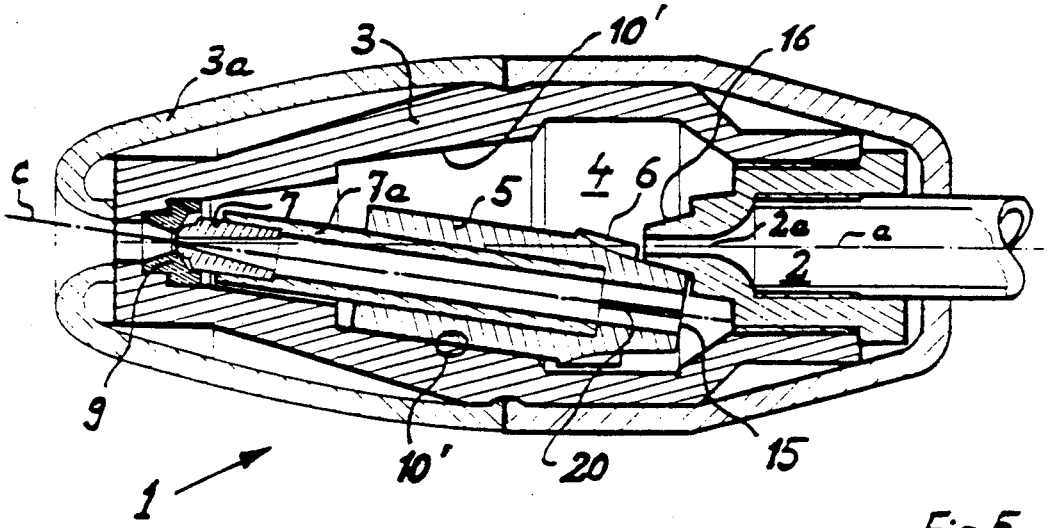
FIG. 5 and 6 are two further embodiments of a rotatable nozzle as modified in respect embodiment of FIG. 1.
Figure 6:
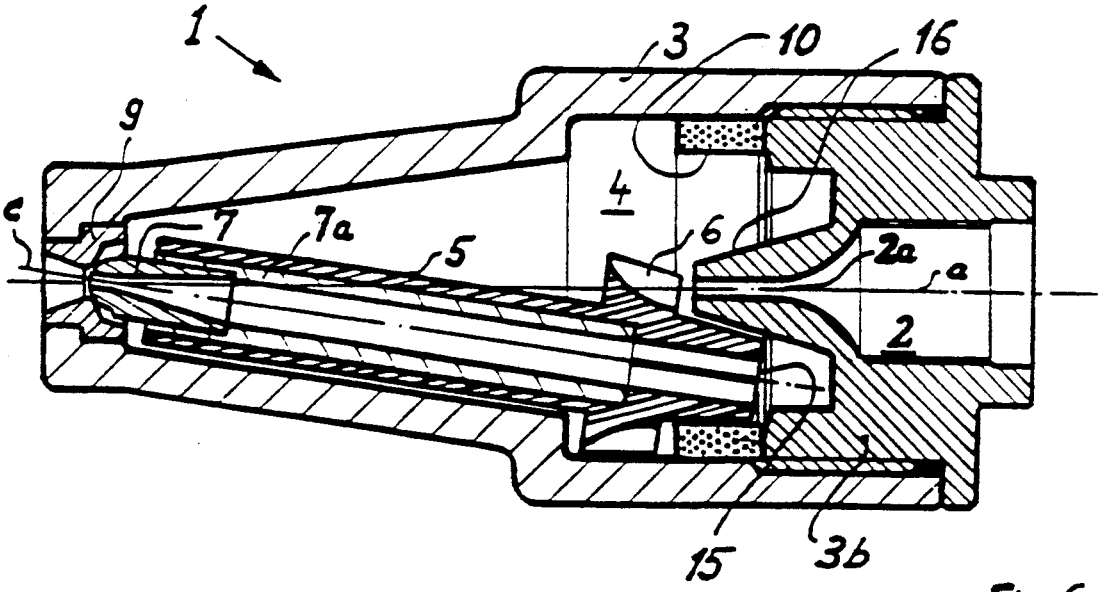

FIGS. 5 and 6 illustrate further simplified embodiments of the rotatable nozzle 1 as modified in respect of the embodiment of FIG. 1. With these embodiments the nozzle body 7*a* is fixedly arranged in the rotor 5, for example, pressed in or embedded by die-casting.

Specifically FIG. 5 illustrates the bearing 10′ already indicated as an alternative for the inlet-side bearing 10. The bearing 10′ is arranged between the blade wheel 6 and the nozzle 7 and is formed by the conical inner surface of the housing 3 supporting rotor 5 at its exterior surface such that the rotor 5 is rolling along a circular path. The contact surface of the bearing 10′ extends from the blade wheel 6 up to close to the nozzle 7 resulting in a large support surface in outward direction. Furthermore, the rotor 5 is supported toward the central axis a by the conical support surface 16 formed around the periphery of the front end portion of the inlet nozzle 2*a*. Thus, the rotor 5 is rotatably held between these two bearing and support surfaces 10′ and 16.

Referring to FIG. 6 the support surface 16 is opposed by the bearing ring 10. In contrast to the bearing 10 of FIG. 1 the bearing ring 10 is inserted into the housing 3 by means of a screw element 3*b* which may be screwed-in into a female threading provided at the rear end portion of housing 3. If necessary, the bearing ring 10 may be simply exchanged; this bearing ring 10 may be formed of material particularly adapted for the rolling movement of the rear end stud of the rotor 5 which stud is provided with the inlet opening 15. For example, the bearing ring 10 may be formed of steel or a synthetic material of high quality whilst the housing 3 may be formed of low quality synthetic material.

We claim:

1. A rotatable nozzle particularly adapted for high pressure cleaning apparatuses comprising:

a housing having provided at a rear end thereof a central inlet opening extending along a central axis of said housing for supply of pressurized liquid and enclosing an essentially cylindrical collecting space;

a rotor rotatably supported in said housing for rotation about a longitudinal axis inclined in respect of said central axis;

a blade wheel means peripherally mounted on a rear portion of said rotor having blades arranged in a path of an inlet beam of said pressurized liquid entering said collecting space through said central inlet opening, causing an orbiting movement of said rotor about said central axis; and a nozzle means arranged at front end of said rotor and having a front end formed as a part of a bearing provided at an outlet side of said housing;

wherein said inlet opening ends in an inlet nozzle having a central axis directed to said blades of said blade wheel.

2. The rotatable nozzle of claim 1, wherein said rotor is provided with a tube-like nozzle body being unitary formed with said rotor.

3. The rotatable nozzle of claim 2, wherein said nozzle means has its rear end formed as a nozzle tube rotatably supported within said nozzle body by a radial bearing.

4. The rotatable nozzle of claim 2, wherein said nozzle means has its rear end formed as a nozzle tube being fixedly arranged within said nozzle body.

5. The rotatable nozzle of claim 1, wherein said rotor is provided with a bearing peripherally surrounding said rotor at a rear portion thereof, said bearing supporting on an inner peripheral surface of said housing.

6. The rotatable nozzle of claim 5, wherein said bearing further supports on an outer peripheral surface of said inlet nozzle.

7. The rotatable nozzle of claim 1, wherein an exit axis of said nozzle means is inclined in respect of said longitudinal axis of said rotor and in respect of said central axis of said housing.

8. The rotatable nozzle of claim 1, wherein said inlet opening has provided therein a throttle means axially adjustable for controlling an amount of pressurized liquid flowing through said inlet opening.

9. The rotatable nozzle of claim 8, wherein said throttle means comprises an inlet nozzle and a nozzle needle axially adjustable by screwing, said inlet opening being further provided with bypass means for diverting of supplied pressurized liquid dependent on the position of said nozzle needle.

10. The rotatable nozzle of claim 1, wherein said rotor has peripherally mounted thereon a gear meshing with an inner gear ring provided at a peripheral inner surface of said housing.

11. The rotatable nozzle of claim 10, wherein the number of teeth of said inner gear ring is at least twice the number of teeth of said gear.

12. The rotatable nozzle of claim 10, wherein the ratio of the number of teeth of said inner gear ring in respect of the number of teeth of the gear is similar to the ratio of the angle between an inclined exit axis of said nozzle means and said central axis of said housing in respect of the angle between said longitudinal axis of said rotor and said central axis.

13. The rotatable nozzle of claim 10, wherein said nozzle means, said blade wheel means, said rotor, and said gear are formed unitary.

14. The rotatable nozzle of claim 10, wherein said inner gear ring is formed unitary with said housing.

* * * * *